United States Patent [19]

Holbrook

[11] Patent Number: 5,039,104

[45] Date of Patent: Aug. 13, 1991

[54] GOLF PRACTICE DEVICE

[76] Inventor: Charles R. Holbrook, P.O. Box 86, New Baltimore, Mich. 48047

[21] Appl. No.: 484,700

[22] Filed: Feb. 22, 1990

[51] Int. Cl.[5] ..... A63B 69/36

[52] U.S. Cl. ..... 273/181 A; 273/181 F; 273/407

[58] Field of Search ..... 273/181 A, 181 F, 400, 273/407, 181 R, 184 R, 410, 411, 182 R, 182 A

[56] References Cited

U.S. PATENT DOCUMENTS

| | | | |
|---|---|---|---|
| 1,392,662 | 10/1921 | Seibold | 273/400 |
| 3,190,657 | 6/1965 | Johnson | 273/181 A |
| 3,540,734 | 11/1970 | Temple | 273/181 A |

*Primary Examiner*—George J. Marlo

*Attorney, Agent, or Firm*—Gifford, Groh, Sprinkle, Patmore and Anderson

[57] ABSTRACT

A golf practice device for use in practicing chipping and pitching techniques. A net is attached to an adjustable ring which is supported by legs connected to the ring. The diameter of the ring can be made smaller thereby challenging the golfers to make a more precise practice shot. The support legs can be variably attached to the ring to create different inclines of the device face with the supporting surface. The ring as well as the support legs are manufactured from a lightweight, strong yet flexible plastic material. The assembly can be dismantled easily for storage or transport.

5 Claims, 1 Drawing Sheet

GOLF PRACTICE DEVICE

BACKGROUND OF THE INVENTION

I. Field of the Invention

The present invention relates generally to a recreational device and more particularly to a golf practice device intended to improve one's skill and accuracy in the performing of chip shots.

II. Description of Prior Art

In the past, different types of practice devices have been developed for golfers in order to improve their level of proficiency in the game or in the various aspects of the game. The target for practicing chip shots must of necessity be a rather large diameter as opposed to a putting practice device. Because the user generally is away from the desired point of descent, a larger diameter is needed with which to practice chipping technique.

A number of golf devices are known and have been used in the golf practice device field. U.S. Pat. No. 4,281,834 to Chavez shows a basically horizontal surface with a ring surrounding it. This device is also equipped with ball returns. When the chip shot successfully lands inside the ring, the ball will roll into a return conduit and be sent back to the individual practicing the golf shots.

U.S. Pat. No. 4,358,116 to Florida, shows a chipping practice target that is also used for putting. This device is a loop of cylindrical tubing supported by at least three support legs. The support legs stabilize the loop and keep it raised from ground level by some distance. This loop is basically coplanar to the ground and does not have a method to gather the balls together. The device is used with a putting stroke to move the ball along the ground or a chipping shot to move the ball through the air to the target ring.

U.S Pat. No. 3,719,362 to Blanchard shows a golf practice device designed to receive chip or pitch shots in a flexible receptacle suspended from a ring. The device is carried by detachable legs and also has a ball return funnel and tube. The Blanchard device utilizes tensiled force to achieve limited angular adjustment of the legs. This tensiled force is created by resilient tie down straps connected between spaced locations on the lower edge of the receptacle.

SUMMARY OF THE INVENTION

It is, therefore, an object of the present invention to provide for an apparatus that is durable, easy to use, and convenient to set up and to take down between practice sessions. A further object of the invention is to provide for a novel golf practice device that is light in weight and easily transported for use.

In accordance with the present invention, the target apparatus has been designed as a circular diameter adjustable ring that can be made smaller to improve the accuracy of the user's shots. It is an object of the present invention to provide a readily assembled practice device which may be made into a relatively small volume for handling and storing.

The golf practice apparatus uses two detachable support legs. These legs stabilize the apparatus and also vary the angle of the open face of the apparatus that is presented to the user. The golf practice device provides a sturdy practice device that is easy to set up, easy to adjust, and quick and simple to dismantle and put away between usages.

BRIEF DESCRIPTION OF THE DRAWINGS

The purpose of the invention in the manner in which it is used as summarized above will be more readily understood by reference to the following description of the preferred embodiment of the invention illustrated in the accompanying drawing wherein.

DETAILED DESCRIPTION OF THE PREFERRED EMBODIMENT

In FIGS. 1 to 5 is illustrated a preferred embodiment of the present invention. The preferred embodiment is specifically adaptable for use as a golf practice device for pitching and chipping. The golf practice device 10 is shown as used in FIG. 1.

The user sets up the ball, and hits it towards the golf practice device.

Figure 2:
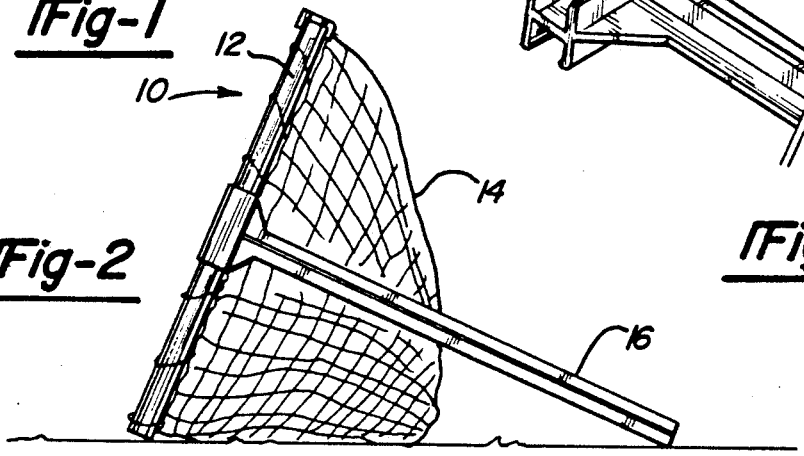
FIG. 2 is a side elevational view thereof.

Referring now to FIG. 2, a side view of the device 10 is thereshown. The device 10 is comprised of an adjustable ring 12, support legs 16, and a net 14. The net is attached to the periphery of the ring.

Figure 3:
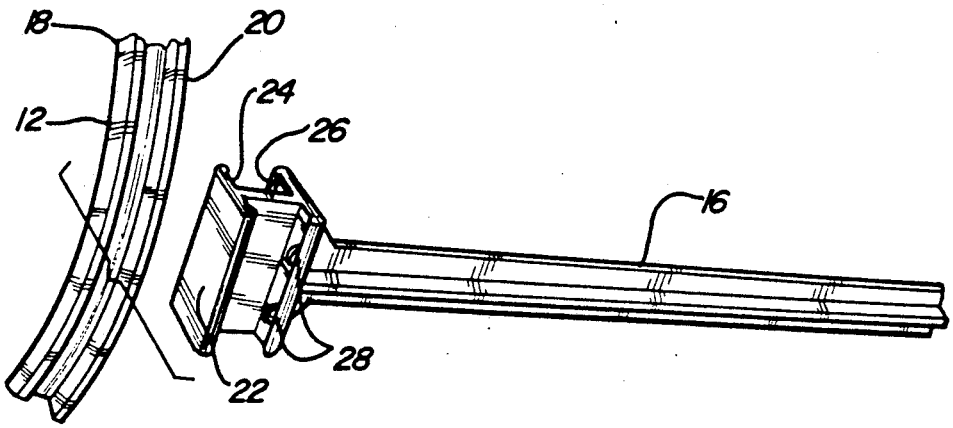
FIG. 3 is a perspective side view of a support leg detached from the ring.

The adjustable ring 12 and one support leg 16 are more clearly shown in FIG. 3. The adjustable ring 12 has one side 18 facing inwards, towards the center of the ring and another side 20 facing outwards or away from the center of the ring.

The support leg 16 has a head 22 at one end which has opposing interior faces 24, 26. These faces have protuberances 28 along their edges. The ring 12 snaps into the space defined by the interior opposing faces and the protuberances 28 frictionally retain the ring 12.

Figure 1:
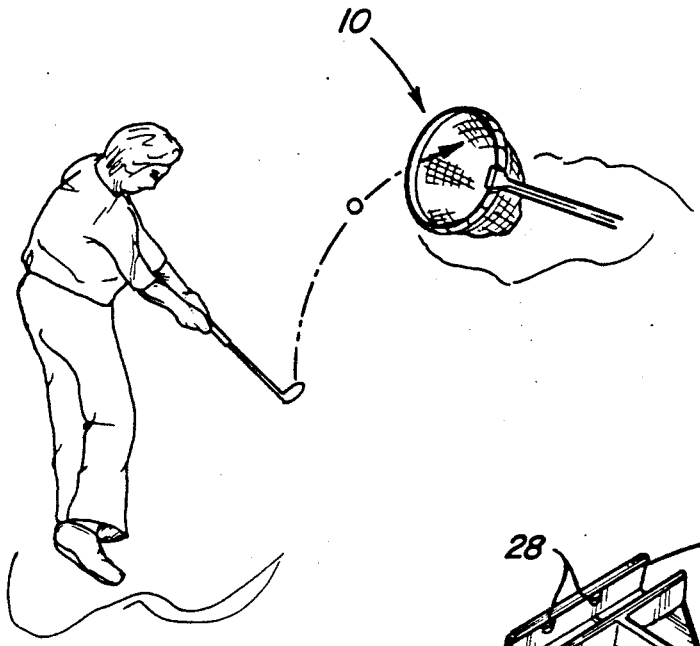
FIG. 1 is a representation of a golfer using the practice device of the present invention.
Figure 5:
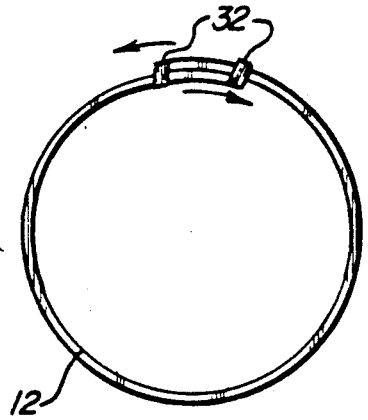
FIG. 5 is front view of the support ring.

The adjustable means is best shown in FIG. 5, in which overlapping ends of the ring have an adjusting device 32. These adjusting devices 32 allow for the ring 12 to be varied in size. Additionally, the adjusting devices 32 prevent the ring 12 from taking a non-circular shape.

Figure 4:
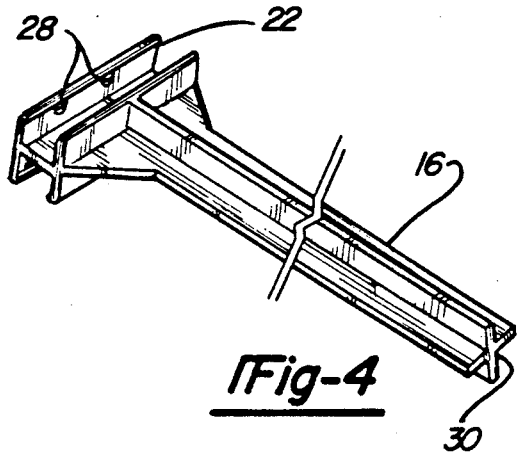
FIG. 4 is another perspective view of a support ring.

FIG. 4 illustrates another view of the support leg 16 also showing the protuberances 28 on the opposing interior faces 24, 26 of the head 22. The bottom 30 of the support leg 16 is shown as having a cross shape.

While the golf practice device 10 is shown with the support legs 16 mounted approximately half way up the side of the ring 12 as in FIG. 2, it is possible to place the legs 16 higher or lower to vary the inclination of the ring 12 to the surface upon which it rests.

Typically the ring 12 and support legs 16 of the golf practice device 10 are made from a somewhat flexible plastic material.

Various modifications, alternative constructions and equivalents may be employed without departing from the true spirit and scope of the invention, as exemplified in the foregoing description and defined in the following claims.

I claim:

1. A golf practice device comprising:

a ring having at least two ends, one of said at least two ends slidingly connected to the other of said at least two ends to provide a ring having an adjustable diameter;

a net attached to said ring;

said ring having an inwardly facing side and an outwardly facing side; and a support leg removably connected to said outwardly facing side of said ring to support said ring at an angle relative to a surface on which said adjustable ring rests.

2. The golf practice device as claimed in claim 1 wherein said at least two ends slidingly overlap each other and wherein each of said two ends has an adjustment device slidingly connecting one of said at least two ends to the other of said at least two ends to permit the adjustment of said adjustable diameter.

3. The golf practice device as claimed in claim 2 wherein said support leg is connectably attachable at different locations on said ring supporting said ring at varying inclines.

4. The golf practice device as claimed in claim 3 wherein said support leg has a head at one end, said head having a first and second interior face, said faces having protuberances to retain said support leg on said outwardly facing side of said ring.

5. The golf practice device as claimed in claim 1 and including another support leg removably attached to said outwardly facing side of said ring at a point spaced from said support leg.

* * * * *